US007360510B2

(12) United States Patent
Bontaz et al.

(10) Patent No.: US 7,360,510 B2
(45) Date of Patent: Apr. 22, 2008

(54) ENGINE PISTON COOLING SYSTEM

(75) Inventors: Christophe Bontaz, Marignier (FR); Michaël Bonvalot, Pringy (FR)

(73) Assignee: Bontaz Centre, Marnaz (FR)

( * ) Notice: Subject to any disclaimer, the term of this patent is extended or adjusted under 35 U.S.C. 154(b) by 154 days.

(21) Appl. No.: 10/941,463

(22) Filed: Sep. 15, 2004

(65) Prior Publication Data

US 2005/0081802 A1 Apr. 21, 2005

(30) Foreign Application Priority Data

Sep. 16, 2003 (FR) ..... 03 10986

(51) Int. Cl.
*F01P 3/08* (2006.01)

(52) U.S. Cl. ..... 123/41.35

(58) Field of Classification Search ..... 123/41.35, 123/195.4, 196 R, 41.34, 41.39
See application file for complete search history.

(56) References Cited

U.S. PATENT DOCUMENTS

| | | | | |
|---|---|---|---|---|
| 4,206,726 | A * | 6/1980 | Johnson et al. | 123/41.35 |
| 5,649,505 | A * | 7/1997 | Tussing | 123/41.35 |
| 6,019,071 | A * | 2/2000 | Maciejka, Jr. | 123/41.35 |
| 6,672,261 | B1 * | 1/2004 | Svensson | 123/41.35 |
| 6,742,481 | B2 * | 6/2004 | Baldwin | 123/41.35 |
| 6,866,011 | B1 * | 3/2005 | Beardmore | 123/41.35 |
| 6,895,905 | B2 * | 5/2005 | Bontaz et al. | 123/41.35 |

FOREIGN PATENT DOCUMENTS

| | | |
|---|---|---|
| DE | 12 16 014 | 5/1966 |
| EP | 1 309 983 | 3/1973 |
| EP | 0 423 830 | 4/1991 |
| FR | 2 745 329 | 8/1997 |
| JP | 6-264742 | 9/1994 |

OTHER PUBLICATIONS

Search Report corresponding to application No. FR 03 10986 dated Apr. 14, 2004.

* cited by examiner

*Primary Examiner*—Stephen K. Cronin
*Assistant Examiner*—Jason Benton
(74) *Attorney, Agent, or Firm*—RatnerPrestia

(57) ABSTRACT

A cooling system comprises at least one common feed manifold carrying a series of nozzles and forming a mechanically rigid assembly, with fixing means for fixing in the engine and with hydraulic connection means for making a hydraulic connection to a feed circuit in the engine. The mechanically rigid assembly is fixed into the engine block from the lower face thereof, the fixing lugs being fixed to easily accessible regions of the engine block before fitting the crankcase. The connection means are fixed into the crankcase and connected to the outlet of the oil filter by a common valve. An internal combustion engine piston cooling system may therefore be fitted without having to modify the structure of the engine block.

16 Claims, 5 Drawing Sheets

ENGINE PISTON COOLING SYSTEM

TECHNICAL FIELD OF THE INVENTION

The present invention relates to internal combustion engine piston cooling systems for spraying a cooling fluid such as oil onto an appropriate region of the pistons.

DESCRIPTION OF THE PRIOR ART

In the internal combustion engines currently under development, the requirement to increase the power supplied by the engine and the requirement to improve the efficiency of the engine necessitate constant improvement in engine cooling conditions, and in particular piston cooling conditions.

This results in the increasingly frequent use of piston cooling systems in which there is associated with each piston of the engine, for cooling it, at least one cooling nozzle that sprays one or more jets of cooling fluid toward the bottom of the piston.

For example, the documents FR 2 745 329, U.S. Pat. No. 4,206,726, EP 0 423 830 and U.S. Pat. No. 5,649,505 describe cooling nozzle structures that are fixed to the wall of the engine block and communicate with an internal cooling fluid feed passage that is machined into the engine block itself and connected to the oil feed circuit in the engine.

The cooling fluid feed pipe and the orifices to which the nozzles are fitted must therefore be provided in the engine block.

The decision to provide an integrated system for cooling the pistons of an engine by means of nozzles is generally taken very early on in the pre-development phase of the engine. It is necessary in particular to carry out hydraulic studies regarding the dimensions of the oil circuit and thermal studies regarding the pistons. Sometimes test engines are specifically constructed to validate these calculations.

However, once the decision has been made not to employ a cooling circuit using nozzles, it is practically impossible to go back on the decision, because there are too many factors to take into account relating to the architecture of the engine and the machining means for fitting and feeding the cooling nozzles.

Accordingly, if an engine is not designed from the outset to be equipped with piston cooling nozzles, there is not necessarily an existing internal feed pipe at the required location and there is no machining to allow for fitting the nozzles. Sometimes, since no consideration was given to this at the outset, machining the engine block to install the nozzles is purely and simply impossible.

Nevertheless, it sometimes happens that a manufacturer needs to reverse the original decision and requires a cooling function using nozzles. In this case, for the reasons referred to above, a complete engine redesign and revalidation are required, which leads to a prohibitive cost that in practice rules out the provision of the cooling system.

The document DE 12 16 014 B discloses an internal combustion engine piston cooling system in which multiple nozzles are fastened to a common feed manifold with which they form a mechanically rigid assembly. The mechanically rigid assembly is fixed to the engine block by screws, which necessitates special machining of the engine block. The feed manifold is hydraulically connected to a pump located nearby, under the engine block. There is no mention of a crankcase.

The document JP 06 264742 A discloses another internal combustion engine piston cooling system. Multiple nozzles are fastened to two common parallel feed manifolds that are fixed together into the bottom of the crankcase. The position of the nozzles rules out accurate directing of the jets of oil, and the jets are inevitably broken up by the moving parts of the engine when in operation.

SUMMARY OF THE INVENTION

The problem addressed by the present invention is that of designing a new structure for a piston cooling system using nozzles that may be integrated into an engine with no or very little modification of the structure of the engine itself.

The object is to fit to an engine whose development has been completed, or whose development has already begun, a piston cooling function using nozzles without having to review the design of the engine itself or to repeat the validations that are essential to the development of any engine.

The invention stems from the observation that the essential difficulty of installing a cooling function using nozzles lies in modifying the engine block itself to feed cooling oil to the nozzles. The invention therefore provides oil feed means that may be fitted into the engine itself without significantly modifying the structure of the engine block.

In conventional engines, a crankcase for recovering oil is attached to the bottom of the engine block containing the moving parts. The crankcase usually carries an oil filter which is connected to the pressurized oil circuit of the engine by a circuit including a section that is therefore accessible inside the crankcase. The invention exploits this arrangement by taking oil from a pressurized oil circuit that is generally present in the area of the crankcase.

The invention also aims to facilitate mounting the cooling system in the engine, especially during steps of assembling heavy and/or bulky subsystems of the engine.

To achieve the above and other objects, the invention proposes an internal combustion engine piston cooling system, said engine comprising an engine block having an open lower face closed off by a crankcase, said system comprising cooling nozzles adapted to receive a pressurized cooling liquid and to spray jets of cooling liquid toward the pistons to be cooled, a plurality of nozzles being fastened to a common feed manifold to which they are hydraulically connected and with which they form a mechanically rigid assembly, in which engine:

- said mechanically rigid assembly is associated with hydraulic interface means for making the hydraulic connection of said common feed manifold to a cooling liquid feed circuit in said crankcase,
- said hydraulic interface means are adapted to make said hydraulic connection as a result of fitting said crankcase under said engine block to close off its open lower face, and
- said mechanically rigid assembly comprises fixing means for fixing it to said engine block away from mobile components and independently of said crankcase.

Because the common feed manifold feeds cooling fluid to the nozzles without recourse to any modification of the engine block, the system may be fitted to an engine that has already been developed or is at the pre-development stage, without having to modify the structure of the engine block, without having to redesign the engine to provide for this modification, and without having to repeat the consequential validations that would then be necessary.

The cooling structure of the invention may of course also be incorporated into an engine yet to be designed.

Furthermore, despite its bulk, the mechanically rigid assembly may be easily fitted and fixed under the open engine, then the hydraulic connection is automatically made by fitting the crankcase, without any supplementary operation.

A first embodiment of the system comprises a single common feed manifold carrying said cooling nozzles disposed in a row facing the row of pistons of an engine with in-line cylinders.

Another embodiment of the system comprises two common feed manifolds each carrying a row of cooling nozzles facing a respective row of pistons of an engine with cylinders in a Vee formation.

The system of the invention may easily be adapted to other engine geometries, for example W-configuration engines, radial engines and any other geometry with more than one row of cylinders.

In one particularly advantageous embodiment, for fitting into an engine having rotary components mounted to rotate in bearings, said fixing means comprise transverse fixing lugs adapted to be fixed to the lower faces of the bearings of said engine.

Practically all internal combustion engines currently developed comprise bearings in which the crankshaft turns and which comprise two main portions assembled together after fitting the crankshaft. The lower portions of the bearings have lower faces that are directly accessible from under the engine before fitting the oil recovery crankcase. It is therefore particularly easy to fix the transverse fixing lugs to the lower faces of the bearings of the engine before fitting the crankcase.

For example, in an engine of the above kind whose bearings are closed by lower bearing blocks retained by fixing threaded studs, said transverse fixing lugs comprise holes for said studs for fixing the lower bearing blocks to pass through, onto which studs said fixing lugs are fixed by locknuts screwed onto said studs.

Alternatively, the fixing means may comprise fixing lugs disposed to be fixed to any other fixed region of the engine block that is easily accessible after fitting the rotating components and before fitting the crankcase.

In one practical embodiment, said mechanically rigid assembly comprises:

- a longitudinal feed tube constituting said common feed manifold, to which are connected transverse tubes whose ends constitute said cooling nozzles, and
- a fixing plate comprising transverse fixing lugs and fixed to said longitudinal feed tube by brazing, welding or adhesive bonding.

Preferably, said fixing plate is bent to a right-angle shape into the corner of which is fixed said longitudinal feed tube, a first flange of the right-angle shape constituting said fixing lugs, a second flange of said right-angle shape having transverse extensions parallel to said transverse tubes and whose end regions are fixed to said transverse tubes by brazing, welding or adhesive bonding.

In one advantageous embodiment, which facilitates assembly, said hydraulic interface means comprise a lower entry orifice in communication with said common feed manifold and fastened thereto and adapted to be connected in a sealed manner to an upper feed orifice in said crankcase as a result of fitting said crankcase under said engine block, said upper feed orifice communicating with the pressurized oil circulation circuit of said engine in said crankcase.

One problem lies in the relative positioning and sealing of the hydraulic connections of the cooling system. These are facilitated and improved by providing a structure in which:

- said lower entry orifice is provided in a plane lower facet of said mechanically rigid assembly in the joint plane between said crankcase and said engine block, and
- said upper feed orifice is provided in a plane upper facet of a connection block of said crankcase in said joint plane between said crankcase and said engine block.

Thus the crankcase seal may simultaneously seal the hydraulic connections.

In this case, it is also advantageous if:

- said upper feed orifice communicates with a junction orifice in said connection block open toward the interior of said crankcase, and
- a connecting pipe is adapted to be housed in said crankcase and to connect said junction orifice and an intake orifice of the oil circulation circuit of said engine in the wall of said crankcase.

Preferably, said upper feed orifice communicates with the oil circulation circuit of the oil filter of said engine on the upstream side or on the downstream side of said oil filter.

A downstream connection benefits from the cleansing effect of the oil filter to prevent the risk of any impurities entrained in the cooling oil clogging the nozzles.

Preferably said hydraulic interface means comprise a valve for controlling the flowrate of said cooling liquid, and, one or more branches at the outlet of said valve for feeding separately one or more common feed manifolds depending on whether the engine has one row of cylinders or more than one row of cylinders.

The invention also provides an internal combustion engine comprising rotary components including pistons mounted in an engine block having an open lower face closed off by a crankcase and cooling nozzles adapted to spray jets of cooling liquid toward the bottom of said pistons, which engine comprises a cooling system as defined above.

BRIEF DESCRIPTION OF THE DRAWINGS

Other objects, features and advantages of the present invention will emerge from the following description of particular embodiments of the invention given with reference to the appended drawings.

DESCRIPTION OF THE PREFERRED EMBODIMENTS

An internal combustion engine piston cooling system of the invention comprises cooling nozzles that are adapted to be fixed into the engine block and are fastened to at least one common feed manifold that is also intended to be attached to the inside of the engine block.

Figure 1:
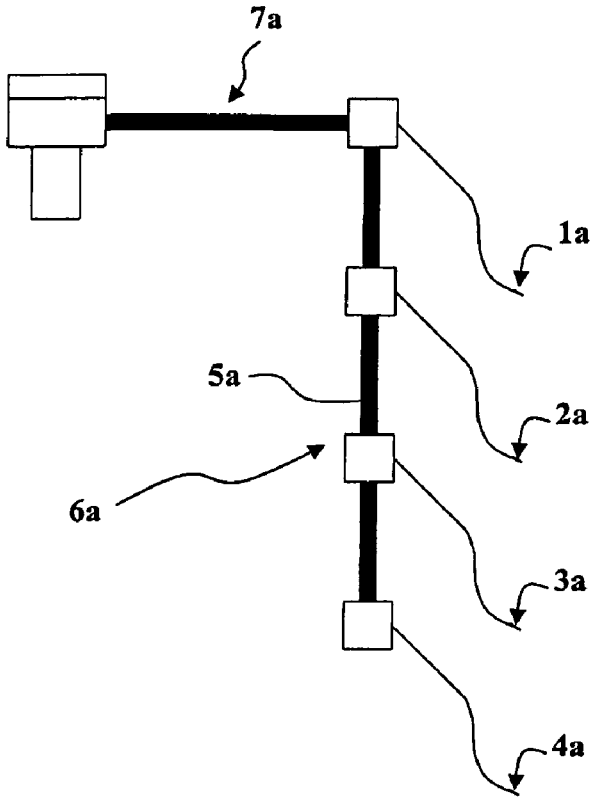
FIG. 1 is a schematic of one embodiment of a cooling system of the invention suitable for an in-line engine.

Accordingly, FIG. 1 shows one embodiment of a cooling system of the invention comprising four nozzles 1*a*, 2*a*, 3*a* and 4*a* fastened to a common feed manifold 5*a* with which they form a mechanically rigid assembly 6*a*.

The nozzles 1*a*-4*a* are hydraulically connected to the common feed manifold 5*a*.

The common feed manifold 5*a* is associated with hydraulic interface means 7*a* for its hydraulic connection to a pressurized cooling liquid feed circuit in the crankcase (not shown in FIG. 1).

Figure 2:
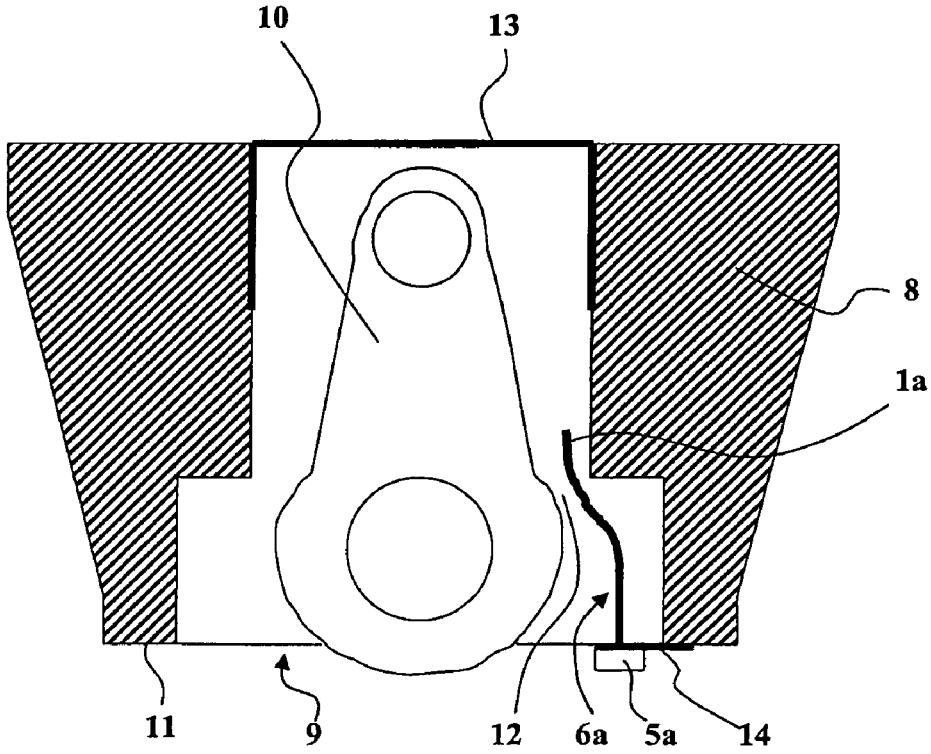
FIG. 2 is a sectional schematic of an in-line engine block showing the fitting of the cooling system shown in FIG. 1.

FIG. 2 shows an engine block 8 whose lower face 9 is open for the insertion of rotary components such as a crank 10 and has a plane lower rim 11 intended to receive a crankcase (not shown).

The nozzle 1*a* fastened to the common feed manifold 5*a* is inserted into the intermediate space 12 between the engine block 8 and the rotary components such as the crank 10 and is joined and connected to the common feed manifold 5*a* by a tube that is appropriately curved to avoid the rotary components. The nozzle 1*a* is oriented to spray a jet of cooling liquid toward the bottom of the piston 13 associated with the crank 10 and also shown diagrammatically.

In the embodiment shown in FIGS. 1 and 2, the system is designed to be fitted into an in-line engine, the cooling nozzles 1*a*-4*a* being disposed in a row facing the pistons of the row of cylinders of the engine. There is then only one common feed manifold 5*a* associated with the hydraulic interface means 7*a*.

As may also be seen in FIG. 2, the common feed manifold 5*a* and the nozzles such as the nozzle 1*a* forming the mechanically rigid assembly 6*a* comprise fixing means 14 for fixing them into the engine away from the mobile components such as the crank 10.

Figure 3:
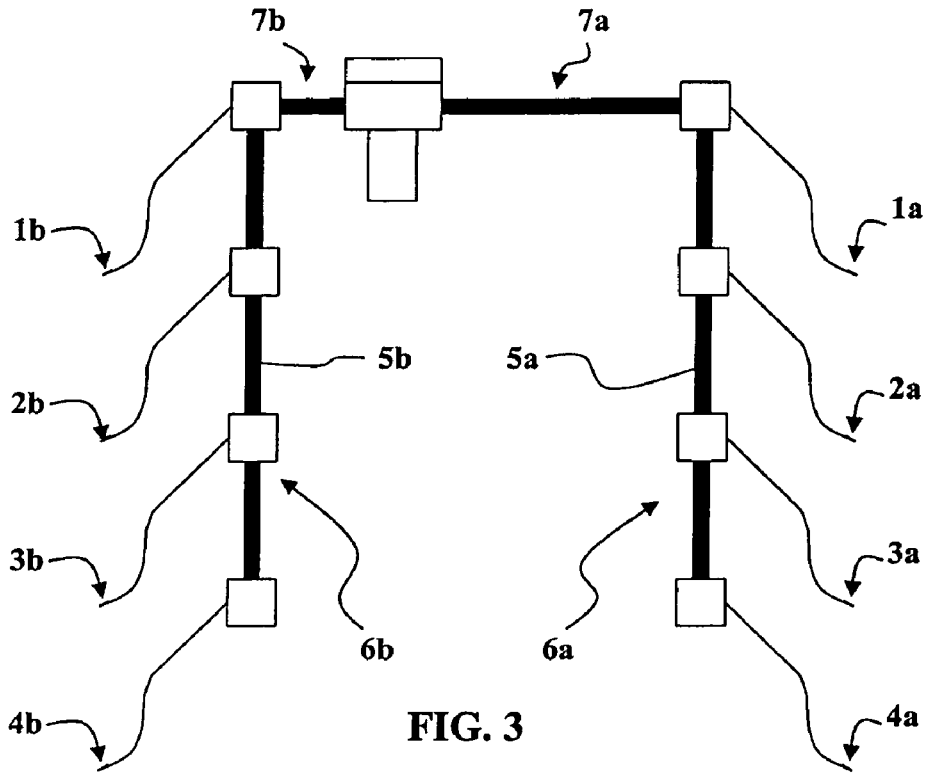
FIG. 3 is a schematic of one embodiment of a cooling system of the invention suitable for an engine with two rows of cylinders in a Vee formation.
Figure 4:
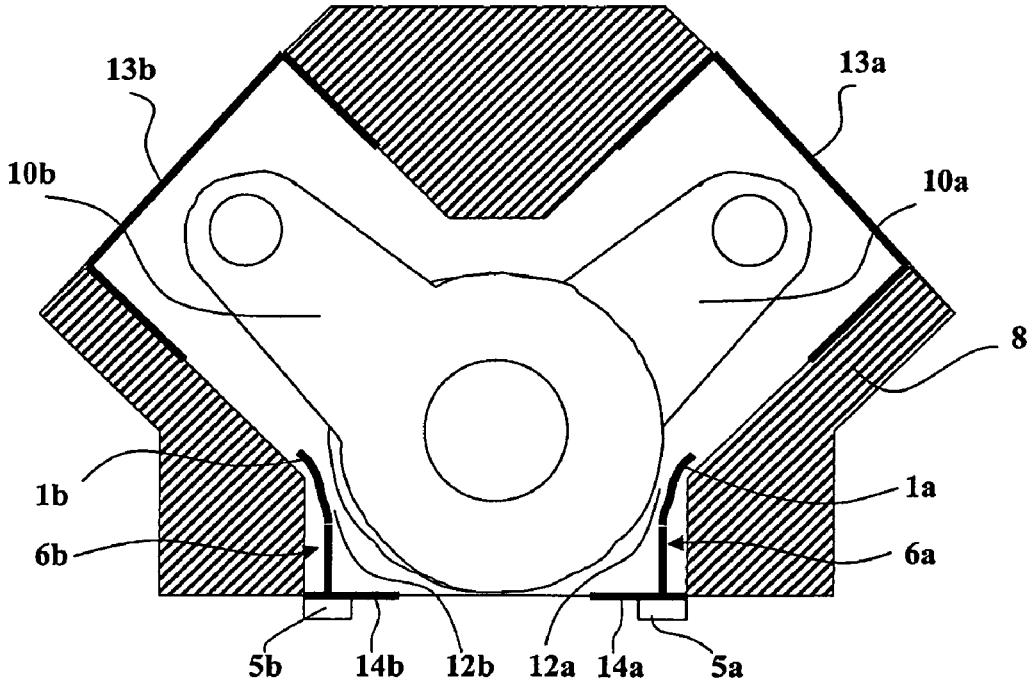
FIG. 4 is a sectional schematic of an engine block with cylinders in a Vee arrangement into which the system shown in FIG. 3 has been fitted.

FIGS. 3 and 4 show a second embodiment of a cooling system of the invention.

The second embodiment comprises the same components as the previous embodiment, namely the nozzles 1*a*, 2*a*, 3*a* and 4*a*, associated with a first common feed manifold 5*a* to form a first mechanically rigid assembly 6*a* with the first hydraulic interface means 7*a*.

There is also a second common feed manifold 5*b* carrying a second row of cooling nozzles 1*b*, 2*b*, 3*b* and 4*b* and forming a second mechanically rigid assembly 6*b* with second hydraulic interface means 7*b* for the hydraulic connection to the cooling liquid feed circuit in the engine. This second embodiment is adapted to be mounted on an engine with two rows of cylinders in a Vee formation.

Accordingly, FIG. 4 shows, inside the engine block 8, a first piston 13*a* and a second piston 13*b* acting on the same central crankshaft via respective cranks 10*a* and 10*b*. The cooling nozzle 1*a* associated with its common feed manifold 5*a* is fitted into the first intermediate space 12*a* to spray a jet of cooling liquid onto the bottom of the first piston 13*a*. Similarly, the second cooling nozzle 1*b* associated with the second common feed manifold 5*b* is fitted into the second intermediate space 12*b* to spray a jet of cooling fluid onto the bottom of the second piston 13*b*.

Thus this second embodiment of the system comprises two common feed manifolds 5*a* and 5*b* each carrying a respective row of cooling nozzles 1*a*-4*a* and 1*b*-4*b* facing a respective row of pistons of the engine with cylinders in a Vee formation.

Each mechanically rigid assembly 6*a* or 6*b* is associated with fixing means 14*a* or 14*b* for fixing it directly to the engine block 8.

Figure 5:
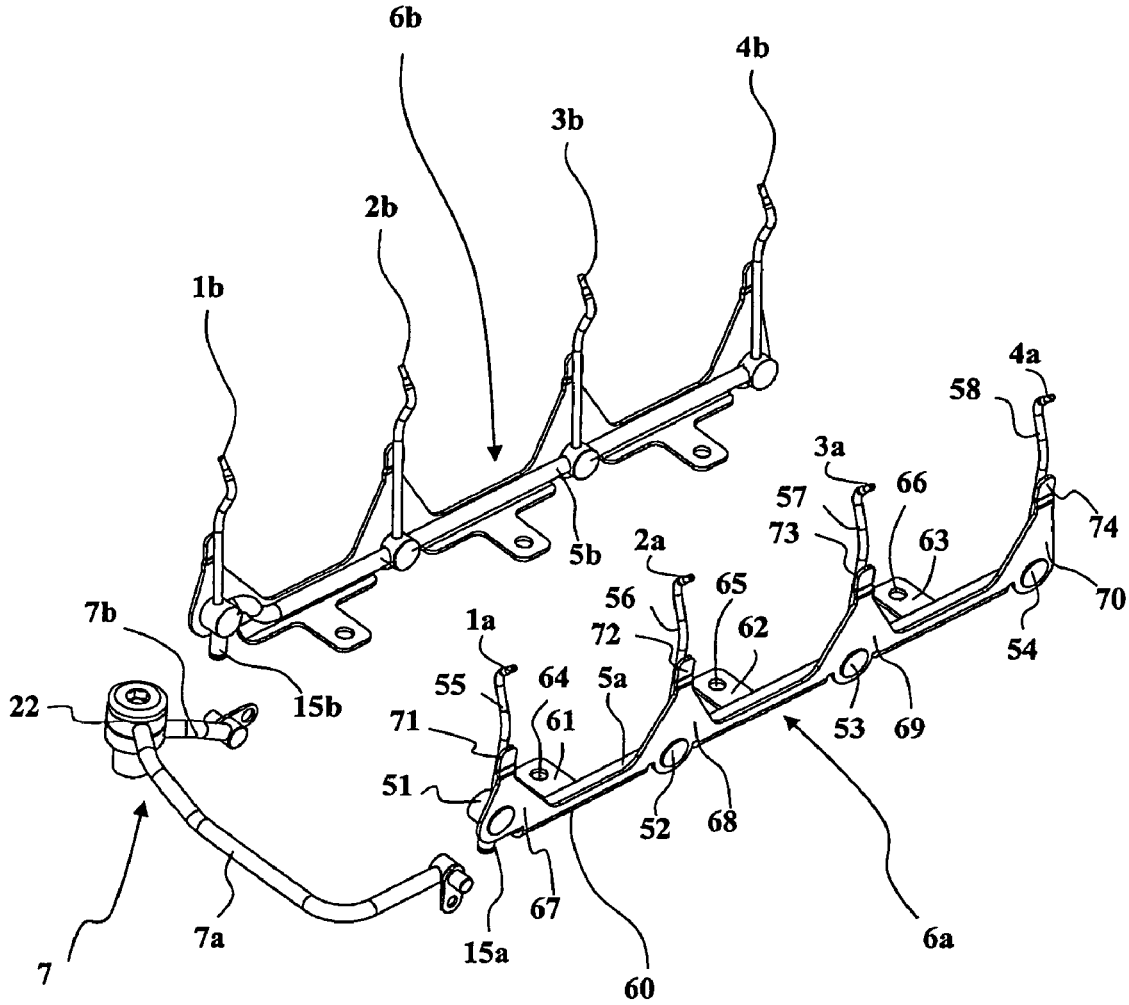
FIG. 5 is a perspective view of the essential components of one embodiment of a cooling system of the invention for a V8 engine.

Consider next the FIG. 5 perspective view, showing the essential components of one embodiment of a cooling system of the invention suitable for installation in a V8 engine.

The figure shows the first mechanically rigid assembly 6*a*, the second mechanically rigid assembly 6*b*, and a third hydraulic interface assembly 7 consisting of the hydraulic interface means 7*a* and the hydraulic interface means 7*b*.

The mechanically rigid assemblies 6*a* and 6*b* are mirror image structures comprising the essential components shown in FIG. 3.

They therefore comprise cooling nozzles 1*a*, 2*a*, 3*a* and 4*a* fastened to a first common feed manifold 5*a* and nozzles 1*b*, 2*b*, 3*b* and 4*b* fixed to a second common feed manifold 5*b*.

These structures being identical, it is essentially the first mechanically rigid assembly 6*a* that will be described. This assembly comprises a longitudinal feed tube forming the common feed manifold 5*a* and comprising connectors 51, 52, 53 and 54 over which are fitted respective transverse tubes 55, 56, 57 and 58 whose respective free ends constitute the nozzles 1*a*, 2*a*, 3*a* and 4*a*.

A fixing plate 60 comprising transverse fixing lugs 61, 62 and 63 is fixed to the longitudinal feed tube forming the common feed manifold 5*a* by brazing, welding, adhesive bonding or any other appropriate fixing means. The fixing lugs 61, 62 and 63 are parallel, oriented inwardly, toward the other mechanically rigid assembly. 6*b*, and each provided with a fixing hole 64, 65 or 66.

In the embodiment shown, the fixing plate 60 is additionally bent to a right-angle shape into the corner of which the longitudinal feed tube constituting the common feed manifold 5*a* is fixed. The first flange of the right-angle fixing plate 60 constitutes the fixing lugs 61-63. The second flange of the right-angle fixing plate comprises respective transverse extensions 67, 68, 69 and 70 that are parallel to the transverse tubes 55, 56, 57 and 58 and whose end regions 71, 72, 73 and 74 are fixed to the respective transverse tubes 55-58 by brazing, welding, adhesive bonding or any other appropriate fixing means. As a result, the transverse extensions 67-70 constitute stiffener means opposing any movement of the nozzles 1*a*-4*a* relative to the remainder of the mechanically rigid assembly 6*a*.

Figure 6:
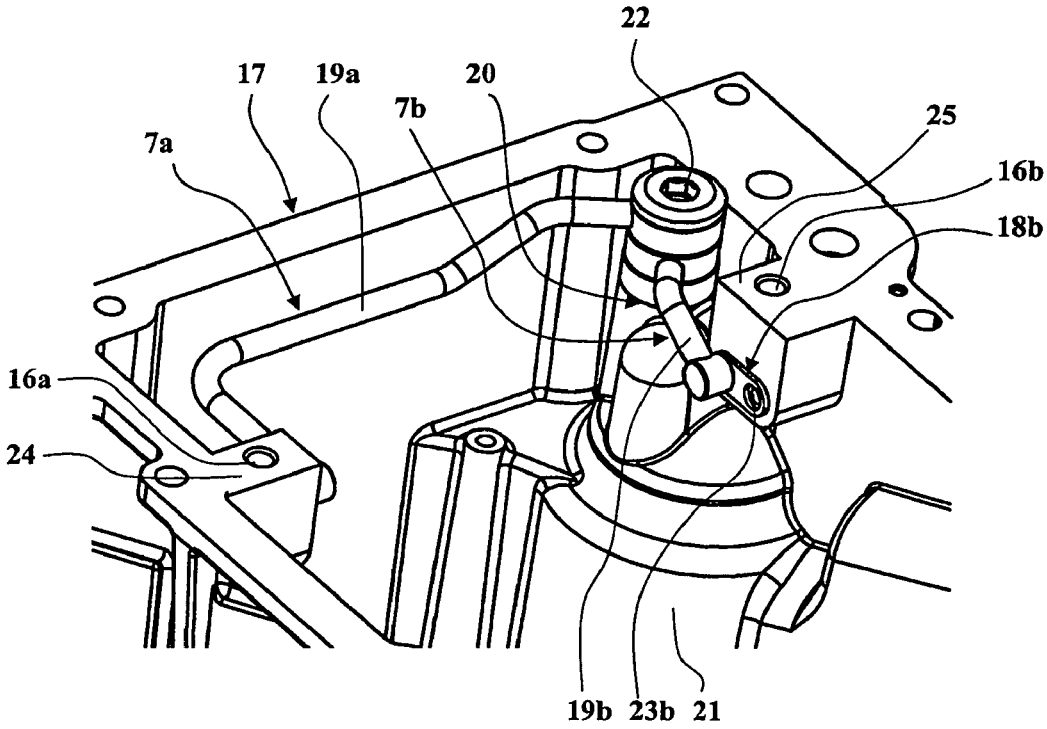
FIG. 6 is a partial perspective view of the upper face of an engine crankcase showing the fitting of the connection means shown in FIG. 5.

For the hydraulic connection of the common feed manifold 5*a* there are provided hydraulic interface means 7*a* comprising, on the common feed manifold 5*a*, a lower inlet orifice 15*a* adapted to be connected and sealed to an upper feed orifice 16*a* in a plane upper facet of a connection block 24 of the crankcase 17 in the joint plane of the crankcase 17, as shown in FIG. 6. The hydraulic connection is effected by the movement of fitting the crankcase 17 under the engine block 8.

The upper feed orifice 16*a* communicates with the pressurized oil circulation circuit of the engine in the crankcase 17.

Similarly, for the hydraulic connection of the common feed manifold 5*b* there are provided hydraulic interface means 7*b* comprising a lower inlet orifice 15*b* adapted to be connected and sealed to an upper feed orifice 16*b* in a plane upper facet of a connection block 25 of the crankcase 17, in the joint plane of the crankcase 17.

In the embodiment shown in more detail in FIG. 6, the upper feed orifice 16*b* communicates with a junction orifice 18*b* open toward the interior of the crankcase 17 and adapted to receive in a sealed manner the end of a second connecting pipe 19*b*. The second connecting pipe 19*b* is adapted to be accommodated inside the crankcase 17 and to connect the junction orifice 18*b* with an intake orifice 20 of the pressurized oil circulation circuit of the engine in the wall of the crankcase 17.

In practice, the intake orifice 20 communicates with the pressurized oil circulation circuit of the engine on the downstream side or on the upstream side of the oil filter 21.

It may be advantageous to provide a valve 22 for controlling the flowrate of the cooling liquid. The valve 22 is fitted to the intake orifice 20 and, when the crankcase 17 is fitted under the engine block 8, delivers the cooling liquid to the second connecting pipe 19*b* which conveys it to the junction orifice 18*b* communicating with the upper feed orifice 16*b* communicating with the second common feed manifold 5*b*.

In the embodiment shown in FIGS. 5 and 6, the valve 22 further communicates with a first connecting pipe 19*a* that, when the crankcase 17 is fitted under the engine block, conveys cooling liquid toward a first upper feed orifice 16*a* connected to the first common feed manifold 5*a*.

The subassembly comprising the two connecting pipes 19*a* and 19*b* and the control valve 22 is inserted into the crankcase 17 and fixed by the valve 22 and by the two ends of the connecting pipes 19*a* and 19*b*, which are fixed to the wall of the crankcase 17, for example by screws inserted into holes in fixing lugs like the lug 23*b*.

Clearly, by virtue of this disposition of the cooling system shown in FIGS. 5 and 6, no modification of the engine block 8 itself is needed. The only modification required to fit the cooling system to an engine that is not originally designed for this entails slightly adapting the crankcase 17 to provide therein or to fix thereto two connection blocks 24 and 25 in which the upper feed orifices 16*a* and 16*b* are provided, together with a communication passage to junction orifices like the orifice 18*b*. It is also necessary to provide a fluid outlet passage from the filter 21 in order to fit the valve 22 and provide a supply of filtered cooling fluid. The filter 21 itself is placed in a section of the pressurized oil circuit of the crankcase 17 connected to the pressurized oil circuit of the engine block, in particular to the oil pump. FIG. 6 shows the inlet orifice 21*a* and the outlet orifice 21*b* of the pressurized oil circuit in the crankcase 17, which communicate with corresponding orifices of the engine block when the crankcase 17 is fitted to close the engine block.

In one possible embodiment, the connecting block(s) 24 and 25 may consist of a portion of the wall itself of the crankcase 17, i.e. they may be in one piece with the crankcase 17.

Alternatively, the connecting block(s) 24 and 25 may be separate components fixed into the crankcase 17.

In the embodiment shown in FIG. 5, the lower inlet orifices 15*a* and 15*b* are simple tubes adapted to be inserted inside the corresponding upper feed orifice 16*a* or 16*b*. Clearly this necessitates careful and accurate positioning of the ends of the tubes facing the orifices when the crankcase 17 is fitted under the engine.

To facilitate this assembly operation, the lower inlet orifice(s) 15*a* and 15*b* may advantageously be provided in a plane lower facet of the mechanically rigid assembly 6*a* or 6*b*, in the joint plane between the crankcase 17 and the engine block. As a result, there is no risk of damaging the ends of the tubes when fitting the crankcase 17 and the hydraulic interface means may be sealed in the joint plane of the crankcase 17 by the crankcase gasket itself, on which there is provided a protrusion for covering the corresponding facets of the connecting blocks 24 and 25 and the mechanically rigid assembly 6*a* and 6*b*.

Figure 7:
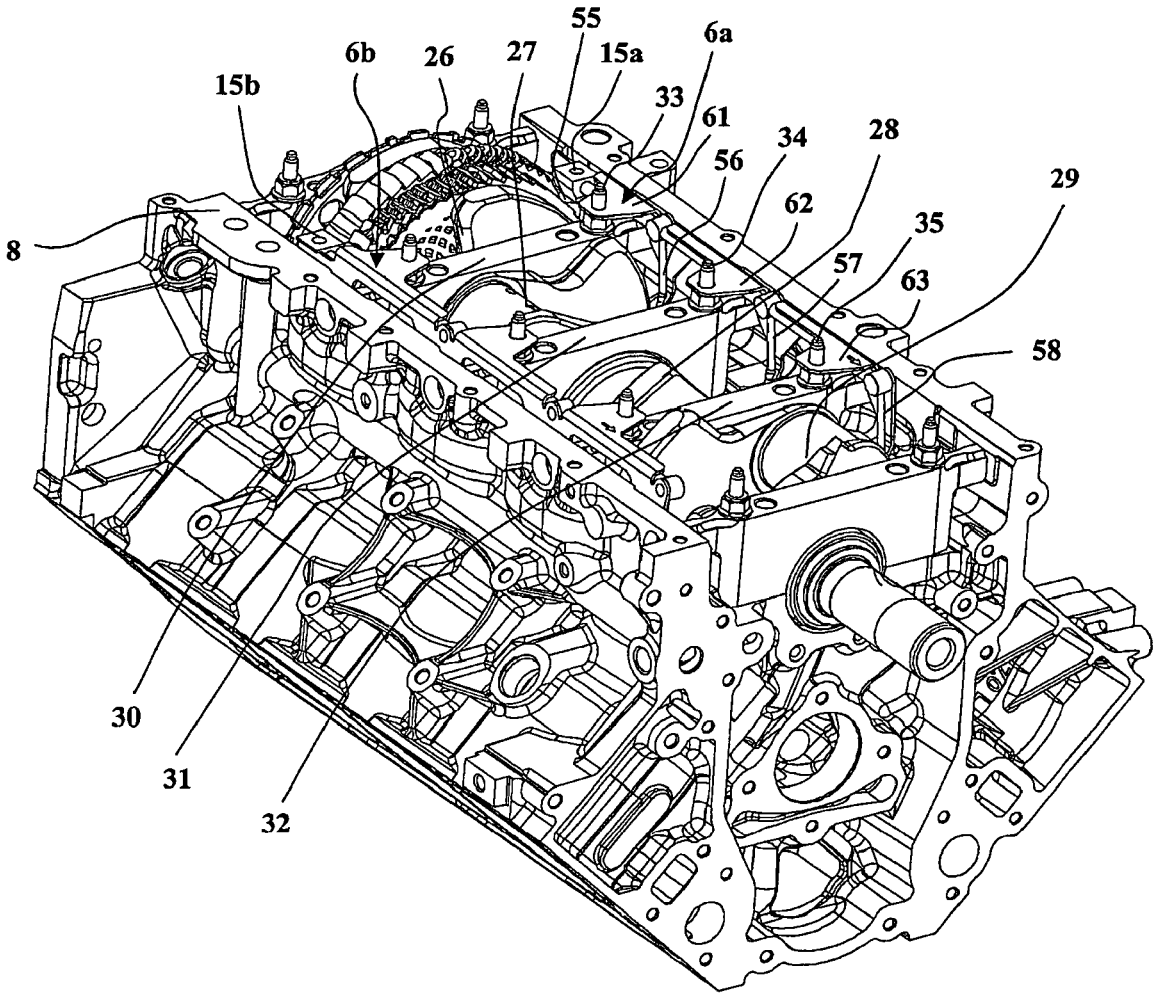
FIG. 7 is a perspective view of the lower face of a V8 engine block showing the fitting of the embodiment of the common feed manifolds shown in FIG. 5.

Consider next the fixing means for the common feed manifolds or mechanically rigid subassemblies 6*a* and 6*b*. For this purpose refer to FIG. 7, showing the lower face of an engine in perspective. The lower face of the engine block 8, facing upward in the figure, is open, and the rotating components 26, 27, 28 and 29 are seen in four compartments separated by bearings 30, 31 and 32.

The first mechanically rigid assembly 6*a* is positioned along a first side of the engine and the second mechanically rigid assembly 6*b* is positioned along the opposite second side of the engine.

The transverse tubes 55-58 enter the engine, as shown in the figure, whereas the shapes of the fixing lugs 61-63 are adapted to the geometry of the engine, these fixing lugs being fixed to regions of the engine block that are easily accessible before fitting the crankcase 17. In the engine shown, the fixing lugs 61-63 are oriented transversely in order to be fixed to lower faces of the respective bearings 30-32 of the engine.

Note that the fixing lugs 61-63 comprise holes for respective threaded studs 33, 34 and 35 for fixing the lower bearing blocks to pass through, onto which studs the fixing lugs 61-63 are fixed by locking nuts (not shown in the figure) screwed onto the studs.

In the case of other engine geometries, and without departing from the scope of the invention, different fixing means adapted to the structure of each engine will be provided, so as to change nothing in the geometry of the engine.

Thus it is clear that no modification needs to be made to the engine block itself to fit the cooling system of the invention.

To fit the cooling system of the invention, the engine is accessed via its open lower face with the crankcase 17 removed. As is clear in FIG. 7, it is then a simple matter to introduce the mechanically rigid assembly or assemblies 6*a* and 6*b*, which are relatively light in weight. They may then be easily fixed to the engine block, as indicated above, the lower entry orifices 15*a* and 15*b* being automatically located in the joint plane between the engine block and the crankcase 17. The crankcase 17 is then fitted, automatically making the hydraulic connection with the pressurized oil circuit section of the filter.

The present invention is not limited to the embodiments that have been described explicitly and encompasses variants and generalizations thereof within the scope of the following claims.

The invention claimed is:

1. An internal combustion engine piston cooling system, said engine comprising an engine block having an open lower face closed off by a crankcase, said system comprising cooling nozzles adapted to receive a pressurized cooling liquid and to spray jets of cooling liquid toward the pistons to be cooled, a plurality of nozzles fastened to a common feed manifold to which they are hydraulically connected and with which they form a mechanically rigid assembly, in which engine:

said mechanically rigid assembly is associated with hydraulic interface means for providing the hydraulic connection of said common feed manifold to a cooling liquid feed circuit in said crankcase, said hydraulic interface means adapted to make said hydraulic connection as a result of fitting said crankcase under said engine block to close off its open lower face, fixing means for fixing said mechanically rigid assembly to said engine block away from moving components and independently of said crankcase, and a single common feed manifold carrying said cooling nozzles disposed in a row facing a row of pistons of an engine with in-line cylinders.

2. An internal combustion engine piston cooling system, said engine comprising an engine block having an open lower face closed off by a crankcase, said system comprising cooling nozzles adapted to receive a pressurized cooling liquid and to spray jets of cooling liquid toward the pistons to be cooled, a plurality of nozzles fastened to a common feed manifold to which they are hydraulically connected and with which they form a mechanically rigid assembly, in which engine:

said mechanically rigid assembly is associated with hydraulic interface means for providing the hydraulic connection of said common feed manifold to a cooling liquid feed circuit in said crankcase, said hydraulic interface means adapted to make said hydraulic connection as a result of fitting said crankcase under said engine block to close off its open lower face, fixing means for fixing said mechanically rigid assembly to said engine block away from moving components and independently of said crankcase, and a plurality of common feed manifolds each carrying a row of cooling nozzles facing a respective row of pistons of an engine with more than one row of cylinders.

3. The cooling system claimed in any one of claims 1 or 2, for fitting into an engine having rotary components mounted to rotate in bearings, wherein said fixing means comprise transverse fixing lugs adapted to be fixed to the lower faces of the bearings of said engine.

4. The cooling system claimed in claim 3, for fitting into an engine whose bearings are closed by lower bearing blocks retained by fixing threaded studs, wherein said transverse fixing lugs comprise holes for said threaded studs for fixing the lower bearing blocks to pass through, onto which studs said fixing lugs are fixed by locknuts screwed onto said studs.

5. An internal combustion engine piston cooling system, said engine comprising an engine block having an open lower face closed off by a crankcase, said system comprising cooling nozzles adapted to receive a pressurized cooling liquid and to spray jets of cooling liquid toward the pistons to be cooled, a plurality of nozzles fastened to a common feed manifold to which they are hydraulically connected and with which they form a mechanically rigid assembly, in which engine:

said mechanically rigid assembly is associated with hydraulic interface means for providing the hydraulic connection of said common feed manifold to a cooling liquid feed circuit in said crankcase, said hydraulic interface means adapted to make said hydraulic connection as a result of fitting said crankcase under said engine block to close off its open lower face, fixing means for fixing said mechanically rigid assembly to said engine block away from moving components and independently of said crankcase, and wherein said hydraulic interface means comprises a lower entry orifice in communication with said common feed manifold and fastened thereto and adapted to be connected in a sealed manner to an upper feed orifice in said crankcase as a result of fitting said crankcase under said engine block, said upper feed orifice communicating with the pressurized oil circulation circuit of said engine in said crankcase.

6. The cooling system claimed in claim 5, wherein:

said lower entry orifice is provided in a plane lower facet of said mechanically rigid assembly in the joint plane between said crankcase and said engine block, and said upper feed orifice is provided in a plane upper facet of a connection block of said crankcase in said joint plane between said crankcase and said engine block.

7. The cooling system claimed in claim 6, wherein said connection block is a portion of the wall itself of said crankcase.

8. The cooling system claimed in claim 6, wherein said connecting block is a separate member fixed into said crankcase.

9. The cooling system claimed in claim 7, wherein:

said upper feed orifice communicates with a junction orifice in said connection block open toward the interior of said crankcase, and a connecting pipe is adapted to be housed in said crankcase and to connect said junction orifice and an intake orifice of the oil circulation circuit of said engine in the wall of said crankcase.

10. The cooling system claimed in claim 9, wherein said upper feed orifice communicates with the oil circulation circuit of the oil filter of said engine on the upstream side or on the downstream side of said oil filter.

11. The cooling system claimed in claim 5, wherein said hydraulic interface means comprise a valve for controlling the flowrate of said cooling liquid.

12. The cooling system claimed in claim 11, wherein said hydraulic interface means comprise a plurality of branches at the outlet of said valve for feeding separately a plurality of common feed manifolds in an engine with more than one row of cylinders.

13. The cooling system claimed in any one of claims 1, 2 or 5 wherein said engine comprising rotary components including said pistons mounted in said engine block having said cooling nozzles adapted to spray jets of cooling liquid toward the bottom of said pistons.

14. The cooling system claimed in any one of claims 1, 3 or 8 wherein said mechanically rigid assembly comprises:

a longitudinal feed tube constituting said common feed manifold, to which are connected transverse tubes whose ends constitute said cooling nozzles, and a fixing plate comprising transverse fixing lugs and fixed to said longitudinal feed tube by brazing, welding or adhesive bonding.

15. The cooling system claimed in claim 14, wherein said fixing plate is bent to a right-angle shape into the corner of which is fixed said longitudinal feed tube, a first flange of the right-angle shape constituting said fixing lugs, a second flange of said right-angle shape having transverse extensions parallel to said transverse tubes and whose end regions are fixed to said transverse tubes by brazing, welding or adhesive bonding.

16. The cooling system claimed in claim 5 for fitting into an engine having rotary components mounted to rotate in bearings, wherein said fixing means comprise transverse fixing lugs adapted to be fixed to the lower faces of the bearings of said engine.

* * * * *